US010141659B2

(12) United States Patent
Trombley

(10) Patent No.: US 10,141,659 B2
(45) Date of Patent: Nov. 27, 2018

(54) EXOTHERMIC AND MECHANICAL ELECTRICAL CONNECTOR

(71) Applicant: Hubbell Incorporated, Shelton, CT (US)

(72) Inventor: Logan Trombley, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/404,817

(22) Filed: Jan. 12, 2017

(65) Prior Publication Data

US 2017/0201032 A1 Jul. 13, 2017

Related U.S. Application Data

(60) Provisional application No. 62/277,687, filed on Jan. 12, 2016.

(51) Int. Cl.
*H01R 4/02* (2006.01)
*H01R 13/621* (2006.01)

(52) U.S. Cl.
CPC ..... *H01R 4/025* (2013.01); *H01R 13/6215* (2013.01)

(58) Field of Classification Search
CPC ..... H01R 4/025
USPC ..... 439/814, 778–790
See application file for complete search history.

(56) References Cited

U.S. PATENT DOCUMENTS 2,920,305 A 1/1960 Gibson et al.
2,957,214 A * 10/1960 Kuharski ..... B23K 23/00 164/100
3,188,602 A 6/1965 Toedtman et al.
3,892,455 A * 7/1975 Sotolongo ..... H01R 4/44 439/100
4,106,832 A * 8/1978 Burns ..... H01R 4/64 439/100
4,169,652 A * 10/1979 Hockele ..... H01R 4/38 439/776
5,292,057 A 3/1994 Lomastro
7,704,104 B2 * 4/2010 Duley ..... H01R 11/12 439/756
8,272,904 B2 * 9/2012 Copper ..... H01R 4/5091 439/781
9,293,841 B2 * 3/2016 Seehoffer ..... H01R 4/30

FOREIGN PATENT DOCUMENTS

EP 1231012 8/2002

OTHER PUBLICATIONS

Wikipedia "Exothermic Welding" retrieved May 16, 2017.*

* cited by examiner

*Primary Examiner* — Ross Gushi
(74) *Attorney, Agent, or Firm* — Michael Best & Friedrich, LLP

(57) ABSTRACT

An electrical connector includes an electrically conductive connector having a mechanical connector for removably receiving a conductor. The mechanical connector includes a translatable clamping member and a threaded portion. An arm extends from the electrically conductive connector. A component is connected to the arm at an interface. The interface includes an exothermic weld.

13 Claims, 3 Drawing Sheets

EXOTHERMIC AND MECHANICAL ELECTRICAL CONNECTOR

RELATED APPLICATION(S)

This application is based on U.S. Provisional Application Ser. No. 62/277,687, filed Jan. 12, 2016, the disclosure of which is incorporated herein by reference in its entirety and to which priority is claimed.

FIELD

Various exemplary embodiments relate to electrical connectors for releasably securing a conductor.

BACKGROUND

Electrical connectors are typically used to mechanically and electrically connect an electrical conductor with another device or component. Different types of connectors may be used depending on the application.

SUMMARY

According to various exemplary embodiments, an electrical connector includes an electrically conductive connector having a mechanical connector for removably receiving a conductor. The mechanical connector includes a translatable clamping member and a threaded portion. An arm extends from the electrically conductive connector. A component is connected to the arm at an interface. The interface includes an exothermic weld.

Other exemplary embodiments are directed to a method of establishing an electrical connection between a conductor and a substrate. An electrically conductive connector having a mechanical connector for removably receiving a conductor and an arm extending from the mechanical connector is placed proximate a support. An exothermic reaction is initiated that produces a molten metal mass to secure the connector to the support. A clamping member is translated to connect a conductor to the mechanical connector.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION

Various exemplary embodiments are related to devices and methods of making electrical connections that utilize both exothermic and mechanical connections. For example, one side of a connector is connected to a surface by a joining process, for example an exothermic weld, and the other side of the connector can include a mechanical connection, for example a range-taking electrical connector, although any style of connector can be used.

Exothermic welds use molten metal to join two components. The welds can be made using a graphite mold to form a weld chamber. Molten material is poured into the weld chamber onto an interface between components to fuse the components together. Material can also be provided between the two components and ignited, forming the molten material that fuses to the two components. Exothermic welds therefore offer a connection that is structurally different than other connections and can provide a stable, high quality electrical connection between two components. Examples of materials that can joined using exothermic welding include copper to copper, copper to steel, and copper to iron. In various exemplary embodiments, the material used to make the weld can include copper oxide and/or aluminum.

Some examples of mechanical connectors include, but are not limited to, pressure plates, split bolts, screw terminals, and parallel groove clamps. In some embodiments, the connector includes a moveable clamping member. The clamping member can be translated via rotation, for example from a threaded connection. The connection to the surface is permanently available, while a conductor can be disconnected as needed. Such a connector can offer a low resistance electrical path between a current carrying conductor and the connection surface.

Figure 1:
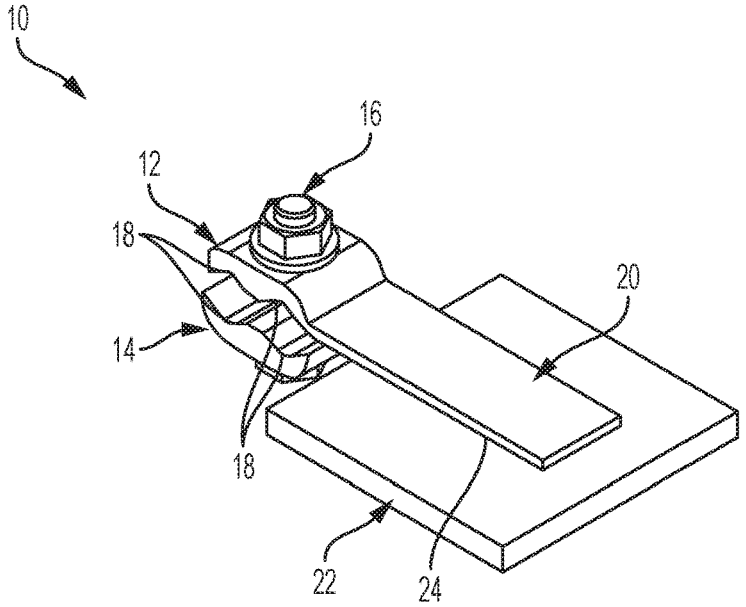
FIG. 1 is a perspective view of an exemplary connector and surface.
Figure 2:
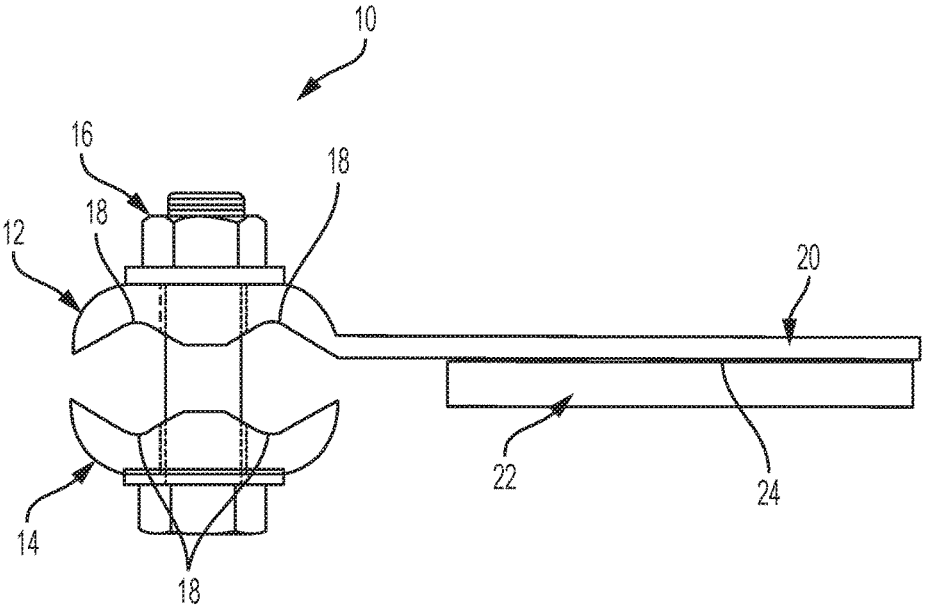
FIG. 2 is a side view of FIG. 1.

FIGS. 1 and 2 show an exemplary embodiment of a connector having a parallel groove clamp 10 with a head 12, a moveable jaw 14, and a fastener 16. The head 12 and the moveable jaw 14 each include a pair of grooves 18 for receiving a conductor. The fastener 16 includes a bolt, a pair of washers, and a pair of nuts. An arm 20 extends from the parallel groove clamp 10. The arm 20 includes a top portion, a bottom portion, a pair of side portions, a first end, and a second end, where the first end is proximate the parallel groove clamp 10. In the exemplary embodiment shown, the arm 20 is configured to have a width substantially equal to the connector, with the top and bottom portion forming major surfaces and the side portions forming minor surfaces. The arm 20 can be integrally formed with the head 12 of the connector or it can be otherwise connected or joined thereto.

The bottom portion of the arm 20 is connected to the surface of a component 22 by an interface 24. The component can be a structural member, such as a wall or beam. The interface 24 is formed through a joining process, for example an exothermic weld. In an exemplary embodiment, the interface 24 is continuous along the area between one or more outer edges of the arm 20 and the component 22. In other exemplary embodiments, the interface 24 is discontinuous, for example formed at certain spots. The component 22 is therefore electrically connected to the mechanical connector through the arm 20.

In various exemplary embodiments, the interface 24 is formed by placing the arm 20 proximate the component 22, for example near, adjacent, or engaging the component 22. Molten material is then used to connect the arm 20 and the component 22. A thermite composition is provided and ignited to fuse the arm 20 and the component 22.

Figure 3:
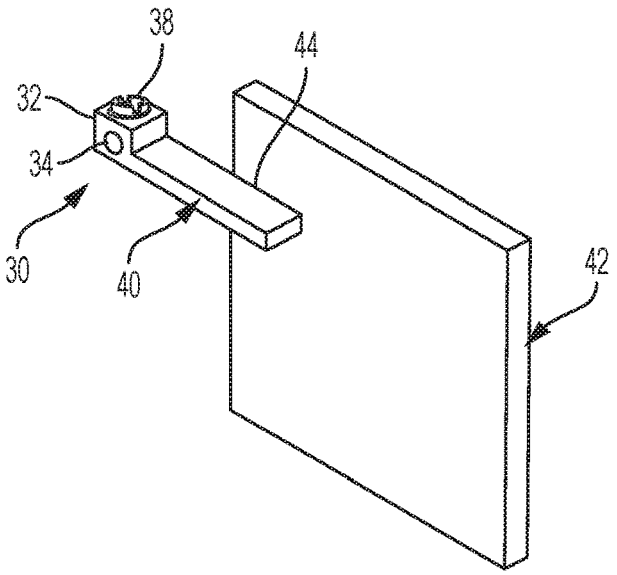
FIG. 3 is a perspective view of another exemplary connector and surface.
Figure 4:
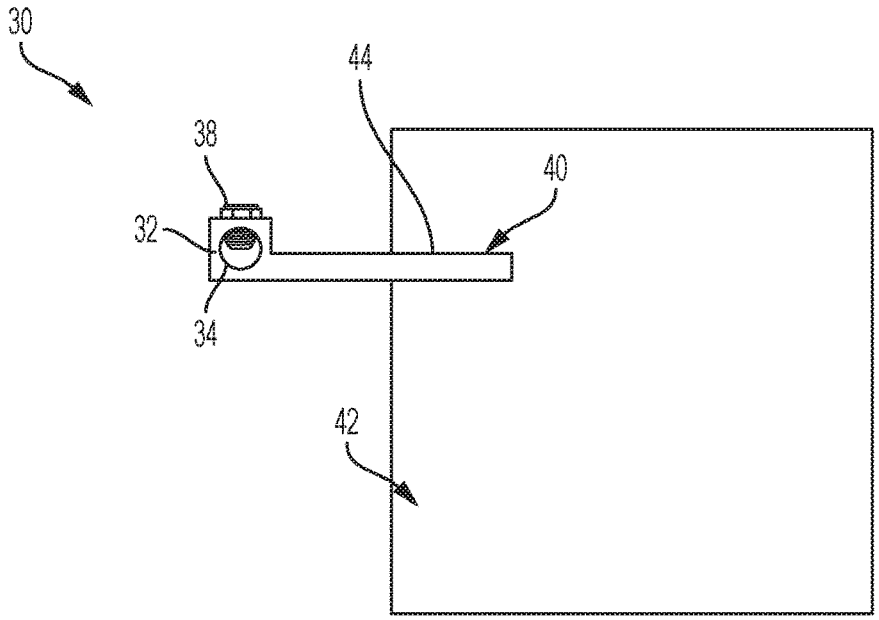
FIG. 4 is a side view of FIG. 3.

FIGS. 3 and 4 show another exemplary embodiment of a connector having a set screw terminal 30 with a base 32 having a first opening 34 to receive a conductor and a second opening receiving a set screw 38. The set screw 38 has a threaded shank, a head for receiving a tool, and a base for engaging the conductor. An arm 40 extends from the set screw terminal 30. The arm 40 includes a top portion, a bottom portion, a pair of side portions, a first end, and a second end, where the first end is proximate the set screw terminal 30. In the exemplary embodiment shown, the arm 40 is configured to have a width substantially equal to the base 32, with the top and bottom portion forming major surfaces and the side portions forming minor surfaces. The arm 40 can be integrally formed with the base 32 of the connector or it can be otherwise connected or joined thereto.

One of the side portions of the arm 40 is connected to the surface of a component 42 by an interface 44. The interface 44 can be formed through a joining process, for example an exothermic weld. In an exemplary embodiment, the interface 44 is continuous along the area between one or more outer edges of the arm 40 and the component 42. In other exemplary embodiments, the interface 44 is discontinuous, for example formed at certain spots.

Figure 5:
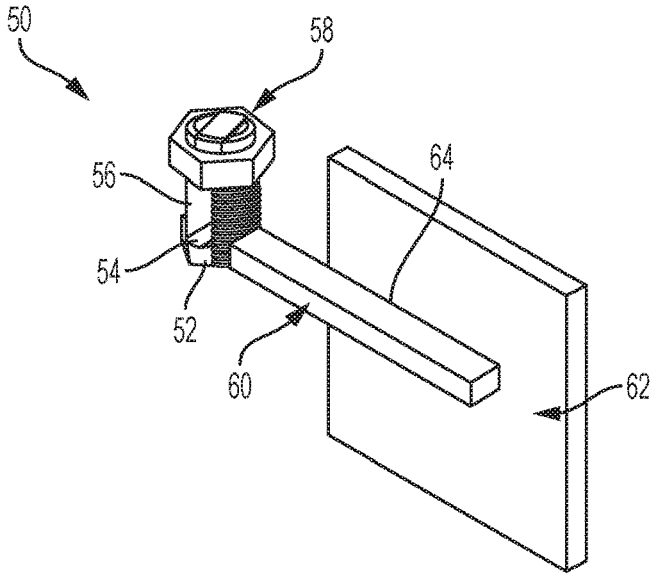
FIG. 5 is a perspective view of an exemplary connector and surface.
Figure 6:
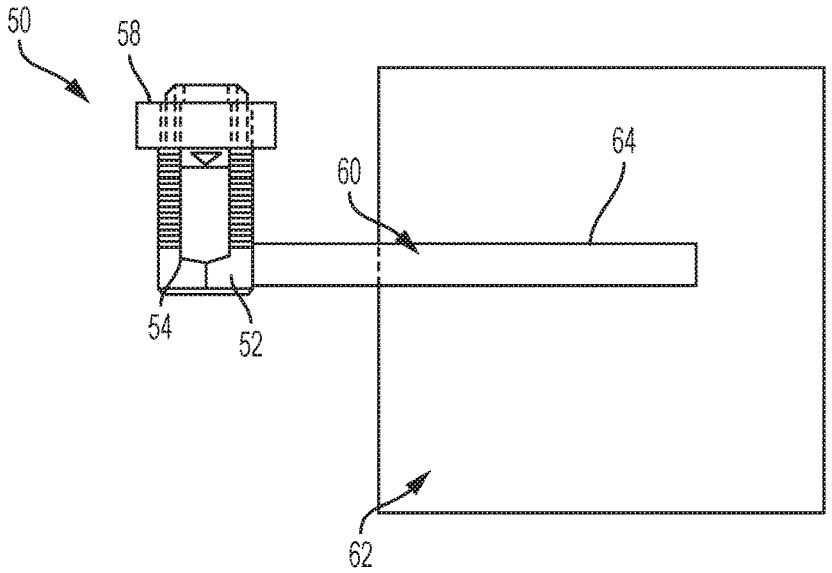
FIG. 6 is a side view of FIG. 5.

FIGS. 5 and 6 show another exemplary embodiment of a connector having a split bolt assembly 50 including a base 52 with a conductor groove 54, first and second legs 56 extending from the base, and a nut and pressure bar assembly 58 threadably engaged with the legs 56. An arm 60 extends from the split bolt assembly 50. The arm 60 includes a top portion, a bottom portion, a pair of side portions, a first end, and a second end, where the first end is proximate the split bolt assembly 50. The arm 40 can be integrally formed with the split bolt assembly 50 or it can be otherwise connected or joined thereto.

One of the side portions of the arm 60 is connected to the surface of a component 62 by an interface 64. The interface 64 can be formed through a joining process, for example an exothermic weld. In an exemplary embodiment, the interface 64 is continuous along the area between one or more outer edges of the arm 60 and the component 62. In other exemplary embodiments, the interface 64 is discontinuous, for example formed at certain spots.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. An electrical connector comprising:

an electrically conductive connector having a mechanical connector for removably receiving a conductor, the mechanical connector including a threaded portion, and a parallel groove clamp comprising a head, a moveable jaw acting as a translatable clamping member, a fastener having the threaded portion, and a nut connected to the fastener;

an arm extending from the electrically conductive connector;

a component connected to the arm at an interface, wherein the interface comprises an exothermic weld, and wherein the arm is integrally formed with the head and includes a bottom portion connected to the component.

2. The electrical connector claim 1, wherein rotation of the nut causes translation of the moveable jaw.

3. The electrical connector of claim 1, wherein the interface is continuous.

4. The electrical connector of claim 1, wherein the interface includes a first exothermic weld and a second exothermic weld spaced from the first exothermic weld.

5. An electrical connector comprising:

an electrically conductive connector having a mechanical connector for removably receiving a conductor, the mechanical connector including a threaded portion, a set screw terminal comprising a base having a first opening configured to receive a conductor and a second opening receiving a set screw, the set screw having base acting as a translatable clamping member and a shank having the threaded portion;

an arm extending from the electrically conductive connector;

a component connected to the arm at an interface, wherein the interface comprises an exothermic weld, wherein the arm is integrally formed with the base and includes a side portion connected to the component.

6. The electrical connector of claim 5, wherein the interface is continuous.

7. The electrical connector of claim 5, wherein the interface includes a first exothermic weld and a second exothermic weld spaced from the first exothermic weld.

8. A method of establishing an electrical connection between a conductor and a substrate comprising:

placing an electrically conductive connector having a mechanical connector for removably receiving a conductor including a parallel groove clamp comprising a head, a moveable jaw acting as a clamping member, a fastener having the threaded portion, and a nut connected to the fastener, and an arm extending from the mechanical connector proximate a support, wherein the arm is integrally formed with the head;

initiating an exothermic reaction that produces a molten metal mass to secure the connector to the support; and translating the clamping member to connect a conductor to the mechanical connector.

9. The method of claim 8, wherein initiating the exothermic reaction comprising igniting thermite powder.

10. The method of claim 8, wherein translating the clamping member includes rotating the fastener.

11. The method of claim 8, wherein the molten metal mass includes copper oxide.

12. The method of claim 8, wherein the molten mass forms an exothermic weld at a first position of the interface.

13. A method of establishing an electrical connection between a conductor and a substrate comprising:

placing an electrically conductive connector having a mechanical connector for removably receiving a conductor including a set screw terminal comprising a base having a first opening configured to receive a conductor and a second opening receiving a set screw, the set screw having base acting as a clamping member and a shank having the threaded portion, and an arm extending from the mechanical connector proximate a support, wherein the arm is integrally formed with the base;

initiating an exothermic reaction that produces a molten metal mass to secure the connector to the support; and translating the clamping member to connect a conductor to the mechanical connector.

* * * * *